US008123910B2

(12) United States Patent
Eagles

(10) Patent No.: US 8,123,910 B2
(45) Date of Patent: Feb. 28, 2012

(54) FORMING FABRICS

(75) Inventor: Dana Eagles, Sherborn, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 13/052,538

(22) Filed: Mar. 21, 2011

(65) Prior Publication Data

US 2011/0253335 A1 Oct. 20, 2011

Related U.S. Application Data

(62) Division of application No. 12/113,507, filed on May 1, 2008, now Pat. No. 7,922,868, which is a division of application No. 10/985,571, filed on Nov. 11, 2004, now Pat. No. 7,384,513.

(51) Int. Cl.
*D21F 1/10* (2006.01)
*D03D 15/00* (2006.01)

(52) U.S. Cl. ..... 162/348; 162/903; 139/383 A; 442/213; 442/301; 156/296; 156/148

(58) Field of Classification Search ..... 162/348, 162/903, 358.2, 900, 902; 139/383 A, 425 A; 442/199–201, 209, 213, 216, 217, 301; 28/110, 28/142; 156/148, 166, 296; 428/111, 175, 428/196; 34/95
See application file for complete search history.

(56) References Cited

U.S. PATENT DOCUMENTS

| | | | | |
|---|---|---|---|---|
| 2,418,904 | A | | 4/1947 | Rugeley et al. |
| 3,928,699 | A | | 12/1975 | Fekete |
| 4,029,639 | A | | 6/1977 | Gragson et al. |
| 4,121,963 | A | | 10/1978 | Yardley et al. |
| 4,154,335 | A | | 5/1979 | Burnett et al. |
| 4,351,874 | A | | 9/1982 | Kirby |
| 4,467,839 | A | | 8/1984 | Westhead |
| 4,632,716 | A | | 12/1986 | Smith |
| 5,094,877 | A | | 3/1992 | Bieringer et al. |
| 5,204,150 | A | | 4/1993 | Davenport |
| 5,360,503 | A | | 11/1994 | Coffy |
| 5,366,797 | A | | 11/1994 | Rotgers et al. |
| 5,454,405 | A | | 10/1995 | Hawes |
| 5,549,967 | A | | 8/1996 | Gstrein |
| 5,614,267 | A | | 3/1997 | Howlett |
| 5,766,391 | A | * | 6/1998 | Fletcher ..... 156/82 |
| 5,776,597 | A | | 7/1998 | Watanabe et al. |
| 5,879,777 | A | | 3/1999 | Shipley |
| 5,888,915 | A | | 3/1999 | Denton et al. |
| 5,929,178 | A | | 7/1999 | Shida et al. |
| 5,965,467 | A | | 10/1999 | Stevenson et al. |
| 6,227,255 | B1 | | 5/2001 | Osterberg et al. |
| 6,294,036 | B1 | | 9/2001 | Loubinoux et al. |
| 6,342,272 | B1 | | 1/2002 | Halliwell |

(Continued)

FOREIGN PATENT DOCUMENTS

| | | | |
|---|---|---|---|
| EP | 0 070 708 | * | 1/1983 |
| EP | 1270807 A | | 1/2003 |

*Primary Examiner* — Eric Hug
(74) *Attorney, Agent, or Firm* — Frommer Lawrence & Haug LLP; Ronald R. Santucci

(57) ABSTRACT

A papermaker's fabric for use as a forming fabric. The fabric may include bondable or meltable monofilament yarns which may be formed from materials that retain substantial strength and tenacity after thermal treatment. Further, the remaining yarns in the forming fabric may be formed from materials that have a higher melting temperature than the monofilament material that will be thermally bonded or melted.

6 Claims, 2 Drawing Sheets

U.S. PATENT DOCUMENTS 6,399,524 B1 6/2002 Creasy
6,491,794 B2 12/2002 Davenport
6,684,911 B2 * 2/2004 Salway et al. ..... 139/383 A
2002/0060047 A1 5/2002 Kobayashi
2004/0206414 A1 10/2004 Festor
2006/0016545 A1 1/2006 Hansen

* cited by examiner

FORMING FABRICS

CROSS-REFERENCE TO RELATED APPLICATIONS

This application is a division of U.S. patent application Ser. No. 12/113,507 filed May 1, 2008 entitled "Forming Fabrics", now U.S. Pat. No. 7,922,868 granted Apr. 12, 2011, which is a division of U.S. patent application Ser. No. 10/985,571 filed Nov. 11, 2004 entitled "Forming Fabrics", now U.S. Pat. No. 7,384,513 granted Jun. 10, 2008, the disclosures of which are incorporated herein by reference.

BACKGROUND OF THE INVENTION

1. Field of the Invention

The present invention relates to the papermaking arts. More specifically, the present invention relates to fabrics, such as forming fabrics, for use with a papermaking machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process, which proceeds at considerable speeds. That is to say, the fibrous slurry is continuously deposited onto the forming fabric in the forming section, while a newly manufactured paper sheet is continuously wound onto rolls after it exits from the dryer section.

Among others, the properties of surface smoothness, absorbency, strength, softness, and aesthetic appearance are important for many products when used for their intended purpose.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of their functions, as implied above, is to form and convey the paper product being manufactured to the press section or next papermaking operation.

The upper surface of the forming fabric, to which the cellulosic fibrous web is applied, should be as smooth as possible in order to assure the formation of a smooth, unmarked sheet. Quality requirements for forming require a high level of uniformity to prevent objectionable drainage marks.

Of equal importance, however, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric that may be woven from monofilament yarns and may be single-layered or multi-layered. The yarns are typically extruded from any one of several synthetic polymeric resins, such as polyamide and polyester resins, metal or other material suitable for this purpose and known by those of ordinary skill in the paper machine clothing arts.

Those skilled in the art will appreciate that most forming fabrics are created by flat weaving, and having a weave pattern which repeats in both the warp or machine direction (MD) and the well or cross-machine direction (CD).

The design of forming fabrics typically involves a compromise between the desired fiber support and fabric stability. A fine fabric having small diameter yarns and a high number of yarns in both the MD and CD directions may provide the desired paper surface and fiber support properties, but such a design may lack the desired stability and wear resistance resulting in a shorter useful fabric life. By contrast, a coarse fabric having larger diameter yarns and fewer of them may provide stability and wear resistance for long service life at the expense of fiber support and the potential for marking. To minimize the design tradeoff and optimize both support and stability, multi-layer fabrics were developed. For example, in double and triple layer fabrics, the forming side is designed for fiber support while the wear side is designed for strength, stability, drainage, and wear resistance.

Many fabrics today, especially triple layer fabrics, comprise two separate fabrics (two complete weave patterns) which are held together by either MD or CD binder yarns as part of the weaving process. They therefore fall into the class of "laminated" fabrics.

However, a shortcoming of laminated fabrics is the relative slippage between the layers of the fabric. This slippage and relative fabric movement ultimately may lead to fabric delamination. Specifically, triple layer fabrics may have a top and bottom layer which may be held together by binder yarns. The top fabric layer may be a plain weave structure, which is designed for optimal paper sheet formation and fabric support. The bottom fabric layer may be designed for wear resistance and may be woven with long floats in which the weft monofilament travels under three or more warp monofilaments. These long floats may be used as an anti-abrasive wear surface. The binder yarn monofilament may be a weft monofilament that mechanically holds the top and bottom fabric layers together by traveling over at least one warp monofilament in the top fabric layer and under at least one warp monofilament in the bottom fabric layer. Under running conditions on the paper machine, the bottom and top fabric layers move relative to each other. This relative movement may lead to fatigue and wear of the binder monofilament due to repeated deflection back and forth within the structure. Eventually, the binder monofilament may fail and allow the top and bottom fabrics to separate (delaminate) from each other.

Further, the lamination of the fabric should not interfere with drainage of the structure such that the sheet of paper formed on the structure has an undesirable mark.

In addition, forming fabrics, especially thin fabrics, may also be prone to wrinkling or folding. Wrinkling or folding may be due to high "sleaziness" of fabric construction. High sleaziness means that the fabric does not have the necessary dimensional stability or CD stiffness to remain flat during operation.

In addition, thin fabrics with very fine MD yarns may have lower seam strength than fabrics with larger diameter yarns. Low seam strength can cause fabrics to prematurely tear during operation.

The present invention provides a fabric with meltable yarns. Such yarns have a melting point lower than the remaining yarns in the fabric. As a result, when the fabric is heated, meltable yarns melt without effecting the remaining yarns and may bond or fuse with yarns in contact therewith or in close proximity thereto. For example, meltable yarns may be formed from MXD6. A monofilament yarn formed from MXD6 is able to maintain its integrity even when the outer surface of the yarn melts. These bonded or meltable yarns may improve seam strength, eliminate edge curl, improve sheet formation, improve planarity, improve dimensional stability and reduce fabric sleaze in all types of fabric, including triple layer fabrics. Such triple layer fabrics may also have improved surface planarity and lower water carrying capacity.

SUMMARY OF THE INVENTION

Accordingly, the present invention is a fabric which may be usable in the forming, as well as, the pressing and/or drying sections of a papermaking machine.

In its broadest form, the fabric may comprise meltable monofilament yarns which may be bonded or fused with other yarns. The meltable monofilament yarns may be formed from materials that retain substantial strength, tensile and other basic properties after thermal treatment. Further, the remaining yarns in the forming fabric may be formed from materials that have a higher melting point temperature than the meltable monofilament material.

According to an embodiment of the present invention, a fabric is provided which comprises a first layer having a plurality of machine direction (MD) yarns and cross-direction (CD) yarns and a second layer having a plurality of MD and CD yarns. The MD yarns and the CD yarns in the first layer and the second layer are monofilament yarns. A group of yarns including at least some of the CD yarns of the first layer and at least some of the CD yarns of the second layer have a first melting point temperature and the remaining yarns have one or more melting point temperatures each higher than the first melting point temperature. The fabric is heated to a predetermined temperature which is at least equal to the first melting point temperature yet lower than each of the one or more melting point temperatures of the remaining yarns. The CD yarns of the first layer of the group and the CD yarns of the second layer of the group which are in contact with each other or in close proximity to each other and which have a first melting point temperature prior to being heated, bond with each other after being heated to the predetermined temperature. Further, the diameter and count of the CD yarns in the first layer and the second layer may be larger than the diameter and count of the MD yarns in the first layer and the second layer to increase the probability of bonding.

In accordance with another embodiment of the present invention, a fabric is provided comprising a first layer having a plurality of MD and CD yarns; a second layer having a plurality of MD and CD yarns and a plurality of binder yarns binding the MD yarns of the first layer and the MD yarns of the second layer or the CD yarns of the first layer and the CD yarns of the second layer. The MD and CD yarns in the first layer and the second layer and the binder yarns are monofilament yarns. A group of the yarns have a first melting point temperature and the remaining yarns have one or more melting point temperatures each higher than said first melting point temperature. The fabric is heated to a predetermined temperature which is at least equal to the first melting point temperature yet lower than each of the one or more melting point temperatures of the remaining yarns. The adjacent yarns of the group which are in contact with each other or in close proximity to each other and which have a first melting point temperature prior to being heated, bond with each other after being heated to the predetermined temperature.

In accordance with another embodiment of the present invention, a fabric is provided comprising a first layer of CD yarns, a second layer of CD yarns, and a plurality of MD yarns binding the CD yarns of the first layer and the second layer. The CD yarns in the first layer may be in a vertically stacked relationship with the CD yarns in the second layer, thereby forming stacked pairs. The present invention may also include a third layer of CD monofilament yarns between the first layer and the second layer of CD yarns and interwoven with the plurality of MD yarns. Further, the third layer of CD yarns may be in a vertically stacked relationship with the CD yarns in the first layer and the second layer to form a triple stacked shute (TSS) double layer fabric. The MD yarns and the CD yarns of the first, second and third layers are monofilament yarns. At least some of the CD yarns of the first, second and third layers are in a vertically stacked relationship with each other, and have a first melting point temperature, and the MD yarns have one or more melting point temperatures each higher than the first melting point temperature. The fabric is heated to a predetermined temperature which is at least equal to the first melting point temperature yet lower than each of the one or more melting point temperatures of the MD yarns so that the CD yarns bond together after thermal treatment.

In accordance with another embodiment of the present invention, a fabric is provided comprising a plurality of MD yarns and CD yarns interwoven in a m-shed repeat pattern, wherein $m \geqq 2$, and a plurality of MD reinforcing (MDR) yarns each having a n-shed repeat pattern, wherein $n \geqq 2$, and the MDR yarns form knuckles with one CD yarn per repeat. The MD and CD yarns, and the MDR yarns are monofilament yarns. At least some of the MDR yarns and at least some of the CD yarns have a first melting point temperature and the MD yarns have one or more melting point temperatures each higher than the first melting point temperature. The fabric is heated to a predetermined temperature which is at least equal to the first melting point temperature yet lower than each of the one or more melting point temperatures of the MD yarns. The MDR yarns which are in contact with or in close proximity to the CD yarns and which have a first melting point temperature prior to being heated, bond to the CD yarns after being heated to the predetermined temperature.

In accordance with another embodiment of the present invention, a fabric is provided comprising a first layer having a plurality of MD and CD yarns, a second layer having a plurality of MD and CD yarns, and a plurality of binder yarns binding the MD yarns of the first layer and the MD yarns of the second layer or the CD yarns of the first layer and the CD yarns of the second layer. The MD yarns and the CD yarns in the first layer and the second layer and the binder yarns are monofilament yarns; and the binder yarns are formed from MXD6.

It should be noted that while mention is made of heating the fabric, or the fabric is heated, this is meant to include heating the entire fabric, a portion or portions thereof or localized heating at selected points by, for example, laser, ultrasound or other means suitable for that purpose.

The present invention will now be described in more complete detail with reference being made to the figures wherein like reference numerals denote like elements and parts, which are identified below.

DETAILED DESCRIPTION OF THE PREFERRED EMBODIMENTS

The present invention relates to a fabric which may be usable in the forming section of a papermaking machine. An embodiment of the present invention will be described in the context of a laminated forming fabric. However, it should be noted that the invention is not limited thereto but may be applicable to other fabrics such as forming fabrics having a single layer, single layer support shute, double layer, double layer support shute, triple stacked shute, triple layer with paired weft or warp binders, warp bound triple layer, shute bound triple layer or combined warp/shute bound triple layer.

Such a laminated fabric may include a first (upper) layer and a second (lower) layer in which each of the first and second layers has a system or plurality of interwoven machine-direction (MD) yarns and cross-machine direction (CD) yarns. The first layer may be a paper side or faceside layer upon which the cellulosic paper/fiber slurry is deposited during the papermaking process and the second layer may be a machine side or wear side layer. Either or both of these layers can be woven as a single layer weave or as a multi-player weave.

Current state of the art, or industry knowledge, regards single-layer fabrics as having one warp, or machine direction, system and one weft, or cross-machine direction, system. Two-layer fabrics consist of one warp system, and two or more weft systems that alone comprise independent forming and wear sides. Three-layer fabrics have been commonly accepted as having at least two different warp systems, and at least two different weft systems with independent forming and wear sides. Note that the terms "weft", "CD yarns" and shute are interchangeable in this context. Similarly, the terms "warp" and "MD yarns" are interchangeable.

Figure 1:
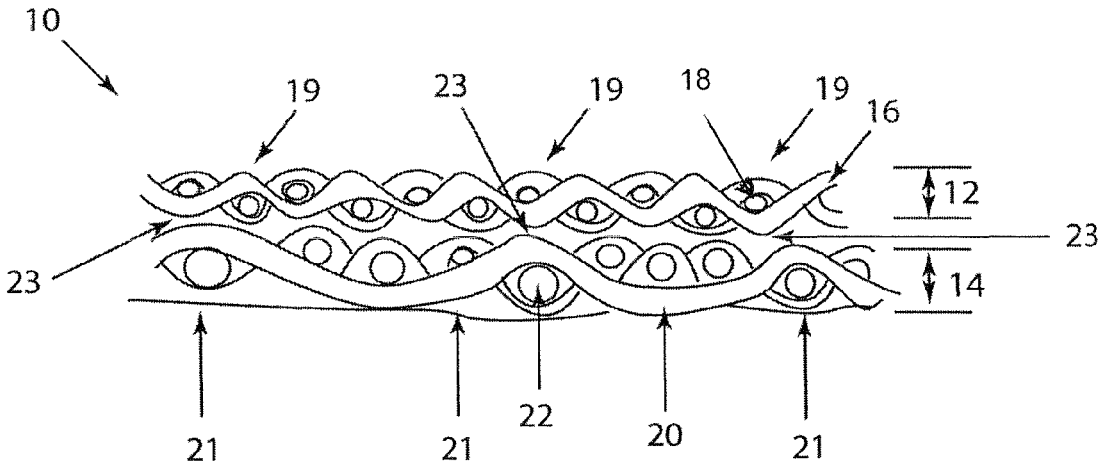
FIG. 1 is a cross-sectional view of a laminated fabric in accordance with an embodiment of the present invention.

FIG. 1 is a cross-sectional view of laminated fabric 10 in accordance with an embodiment of the present invention. More specifically, FIG. 1 is the cross-sectional view of a part of fabric 10 taken along the cross-machine direction, including a first (paper side) layer 12 and a second (machine side) layer 14. First layer 12 has a plurality of interwoven CD yarns 16 and MD yarns 18 forming knuckles 19 at cross-over points, and second layer 14 has a plurality of interwoven CD yarns 20 and MD yarns 22 forming knuckles 21 at cross-over points.

At least some of the CD yarns 16 and 20 may be bondable or meltable monofilament yarns formed from the same polymer having a first melting point temperature. The remaining yarns in the fabric may be formed from materials having a higher melting temperature than the monofilament material. The fabric may then be heated to the first melting point temperature so that CD yarns 16 and 20 partially melt and bond to each other. The bondable monofilament yarns may be formed from a material that retains substantial strength and elasticity after melting. The bonded yarns in the structure may be strong and will prevent first layer 12 and second layer 14 from delaminating from each other.

Thermally treating monofilaments yarns formed from the same polymer may require a specific combination of temperature, time and tension in order for the yarns to retain substantial strength and tenacity after bonding. Exceeding the temperature range, time, or failing to maintain the proper tension for a particular monofilament polymer may result in either complete melting or substantial loss of mechanical characteristics of the monofilament yarn. Table 1 lists a general time and temperature range that may be used for thermal bonding or partially melting yarns of the present invention:

TABLE 1

| Polymer type | Temperature (° C.) | Tension (cN/dtex) | Time (seconds) |
|---|---|---|---|
| MXD6 | 230-234 | .07-.25 | 60-180 |
| Nylon, 6, 10 | 221-224 | .07-.25 | 60-180 |
| Nylon, 6, 12 | 212-214 | .07-.25 | 60-180 |
| Polyethylene terephthalate (PET) | 240-256 | .06-.22 | 60-180 |

The melting point temperature for a material may be a value within the full temperature range of its melting endotherm, which may determined by a Differential Scanning calorimeter (DSC) scan measured at a predetermined scanning rate. The DSC scan may provide a measure of the rate of heat evolution or absorption of a specimen which is undergoing a programmed temperature change. Typically, in a DSC scan, data may be plotted as heat flux or heat flow, versus temperature. The scanning rate may be, for example, 20° C. per minute. Thus, the melting point temperature for PET may have a value from 240° C. to 256° C. Furthermore, and as noted above, a specific combination of temperature, time and tension may be needed to form an acceptable bond.

CD monofilament yarns 16 and 20 may be formed from MXD6. MXD6 may be formed by the polycondensation of meta-xylylene diamine and adipic acid. The MXD6 polymer may be available from Mitsubishi Gas Chemical Co., Inc. and Solvay Advanced Polymers, L.L.C.

Other suitable monofilament yarns may be formed from one of polyester, polyamide (PA) or other polymeric materials known to those skilled in the art of papermaking, such as polyamide 6,12 and polyamide 6,10. As is appreciated, other polymers may be used for the CD monofilament yarns in first layer 12 and in the second layer 14 PA or a combination of polyethylene terephthalate (PET) and PA suitable for this purpose.

The remaining yarns in the forming fabric may be formed from materials that do not thermally bond or melt at the bonding temperature, i.e., made from materials that have a higher melting point temperature than the melting point temperature of the monofilament material that will be thermally bonded, fused or melted. For example, polyethylene naphthalate (PEN) monofilaments may have a melting point temperature of 275° C. Also, PET may have a melting point temperature of 256° C. Thus, the melting point temperature of polymers, such as PEN and PET may be suitable for the remaining MD monofilament yarns in fabric 10.

The thermal treatment temperature may be between 230° C. and 234° C. for MXD6 monofilaments, as listed in Table 1. This temperature is well below the melting temperature for PEN or PET monofilament yarns. As a result, the warp monofilament yarn formed from PEN or PET may be unaffected during thermal treatment. PEN or PET may be suitable for warp yarns because these materials have a high modulus of elasticity, which may provide fabric 10 with high dimensional stability. In addition, during thermal treatment, a portion of the machine direction crimp in the PEN monofilaments may be reduced or eliminated. As the monofilament formed from MXD6 partially melts, the PEN monofilament elongates and crimp angles in the warp monofilament may be reduced, resulting in higher fabric modulus, and dimensional stability.

As shown in FIG. 1, CD monofilament yarns 16 and 20 may be bonded to each other after thermal treatment at bonding locations 23. In the fabric 10, all of the CD monofilament yarns 16 and 20 may be bonded to each other after thermal treatment. Alternatively, less than all of these CD yarns (such as every second, third or nth yarn) may be bonded to each other.

Bonding of these yarns depends upon the probability that knuckles, overlaps, or cross-over points between CD and MD yarns, formed within the first layer 12 and second layer 14 align. This probability may be increased or decreased by the weave patterns in first layer 12 and second layer 14. Here, first layer 14 may be in a plain weave pattern. This weave pattern provides many contact points which may increase the probability of bonding. In addition, second layer 16 may be in a 5 shed weave pattern for increasing wear resistance as mentioned above. Other weave patterns such as a 4-shed design are possible for the bottom layer. As is appreciated, other possible weave patterns would be apparent to those of skill in the art. The present invention eliminated the need for binder yarns to secure the first and second layers.

Further, the diameter of CD yarns 16 may be larger than the diameter of MD yarns 18 to further increase the probability and accessibility for thermal bonding to occur. Likewise, CD yarns 20 may also have a larger diameter than MD yarns 22. Notably, the larger size diameter may also create a plane difference in the second or wear layer resulting in increased resistance to abrasion.

The laminated forming fabrics of the present invention may be formed by weaving the first layer and the second layer on two independent looms. After weaving, each layer may be independently heat set at a temperature well below the melting temperature of the lowest melting yarn in the fabric. After heat setting, each layer may be independently seamed by any manner known to those so skilled in the art. For example, the loop length for both layers may be set such that the loop of the second layer easily fits within the loop of the first layer. This fit may be snug to avoid the need of stretching either of the first layer or the second layer so that the first layer is within the second layer.

After the two layers are fitted together, the two layer construction may be subjected to a thermal treatment sufficient to partially melt the bondable monofilaments that may be aligned between the first layer and the second layer. Bonding may be accomplished such that a substantial portion of the strength of the monofilament is retained, while also achieving an effective thermal bond. If excessive melting or loss of structural integrity of the weft monofilament were to occur, then at least some of the monofilaments yarns or a portion of the monofilament material may be replaced with a higher melting monofilament material, such as PET. The higher melting monofilament material may maintain the integrity of the woven structure while also achieving thermal bonds with the remaining meltable monofilaments that are positioned for this purpose. After bonding, the product may be trimmed to size with finished edges. As is appreciated, other methods of forming the fabric may be apparent to those skilled in the art.

Figure 2:
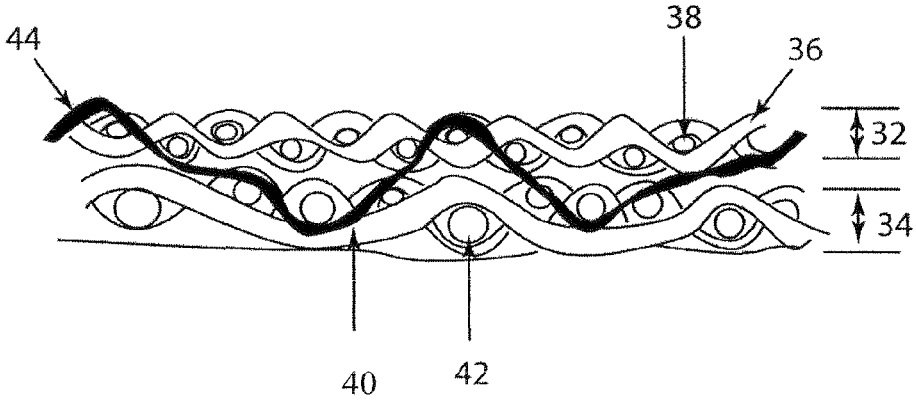
FIG. 2 is a cross-sectional view of a triple layer fabric in accordance with an embodiment of the present invention.

FIG. 2 is a cross section of triple layer fabric 30 in accordance with another embodiment of the present invention. More specifically, FIG. 2 is a cross-sectional view of a part of fabric 30 taken along the cross-machine direction, which includes a first (paper side) layer 32 and a second (machine side) layer 34. First layer 32 has a plurality of interwoven CD yarns 36 and MD yarns 38 and second layer 34 has a plurality of interwoven CD yarns 40 and MD yarns 42. Further, fabric 30 includes binder yarns 44 interwoven with first layer 32 and second layer 34 in the cross-machine direction. Alternatively, binder yarns 44 may be in the machine direction and/or may be formed of pairs of binder yarns. As is appreciated, the yarns in forming fabric 30 may have different diameters, sizes, or shapes that would be apparent to those so skilled in the art. Fabric 30 further comprises a group of bondable or meltable monofilament yarns having a melting point temperature lower than the melting point temperature or temperatures of the remaining yarns.

For example, some of the CD monofilament yarns 36 and MD monofilament yarns 38 of first layer 32 may be bondable yarns having a first melting point temperature. These bondable yarns may be formed from MXD6. All of the remaining yarns in the forming fabric may be formed from materials that do not melt at the first melting point temperature, but may have a higher melting point temperature, such that of PEN and PET. PEN may be used as the material forming MD yarns 40 and PET or polyamide may be used as the material forming the CD yarns 42 and binder yarns 44. Accordingly, during thermal treatment CD monofilament yarns 36 and MD monofilament yarns 38 of first layer 32 partially melt and bond to each other. The bondable monofilament yarns may be formed from a material that retains substantial strength and elasticity after melting.

Alternatively, only the CD monofilament yarns 36 in first layer 32 may be formed of meltable yarns, e.g. MXD6. The remaining yarns may be formed of PEN, PET or higher melting polyamide.

Thus, at least some of the CD or CD and MD yarns in the first layer may be meltable and/or bondable yarns. Additionally, at least some of the CD and/or MD yarns in the second layer may be meltable and/or bondable yarns.

Further, binder yarn 44 of fabric 30 may be formed from a material having a first melting point temperature. Binder yarn 44 may be heated to the first melting point temperature so as to distort its shape. Binder yarn 44 may then be less prominent in the paper side of fabric 30, thus reducing sheet marking.

Figure 3:
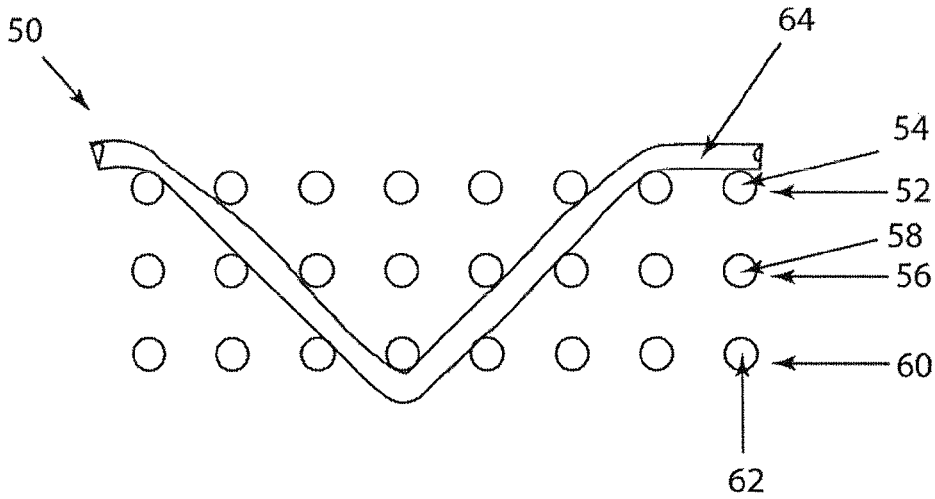
FIG. 3 is a cross-sectional view of a triple stack shute fabric in accordance with an embodiment of the present invention.

FIG. 3 is a cross-sectional view of a portion of fabric 50 including first (top) layer 52 of CD yarns 54, a second (middle) layer 56 of CD yarns 58, a third (bottom) layer 60 of CD yarns 62, and a system of MD yarns 64 interwoven with the top, middle and bottom layers. CD yarns 54, 58 and 62 are in a vertically stacked relationship and may be formed from materials having a first melting point temperature while the remaining yarns are selected from a material with a melting point temperature higher then the first melting point temperature. Thermally treating or heating the fabric 50 to the first melting point temperature partially melts at least some of CD yarns 54, 58, and 62 which may lead to increased cross-machine direction stiffness and resistance to edge curl. Further, bonding may also lead to reduced fabric caliper since yarns may flatten or may partially melt at cross-over points and be more "planar" thereby reducing the void volume in the structure.

Figure 4A:
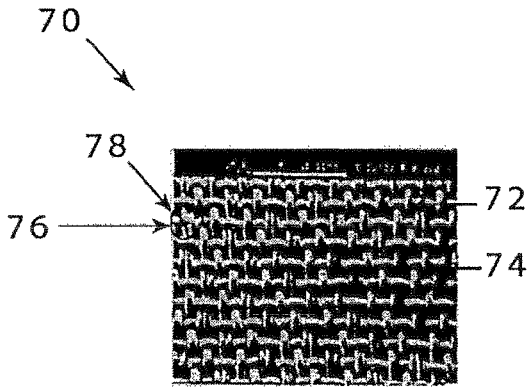
FIGS. 4A and 4B are paper side and wear side views of a modified thin triple layer fabric in accordance with an embodiment of the present invention.
Figure 4B:
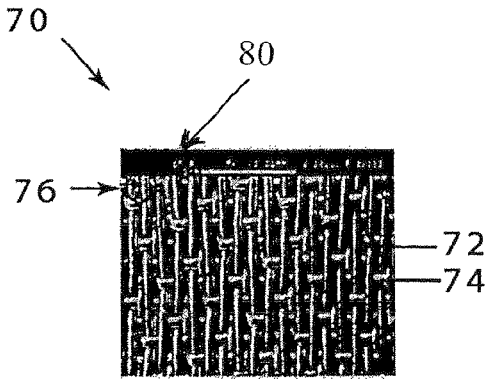

Bondable or meltable yarns of the present invention may also be used in a modified thin triple layer fabric (modified warp-reinforced woven fabric) as provided in U.S. Pat. No. 6,227,255, hereby incorporated by reference. FIGS. 4*a* and 4*b* are the paper side and wear side views of fabric 70 in accordance with another embodiment of the present invention. Thin triple layer fabric 70 provides MD monofilament yarns 72 and CD monofilament yarns 74 in an m-shed repeat pattern, wherein m≧2, and MD reinforcing (MDR) yarns 76. MDR yarns 76 interweaves between CD monofilament yarns 74 in an n-shed repeat pattern, wherein n≧2, and preferably n≧5 and MDR yarns 72 form knuckles with one CD yarn per repeat. (It should be noted that m and n may or may note have the same value.). MD monofilament yarn 72 may be formed from PEN while the CD monofilament yarns 74 may be formed from bonded or meltable yarns, such as MXD6. The MDR yarns 76 may be formed from the same polymer as CD monofilament yarns 74, in this case MXD6. Bonding may occur at knuckles formed at crossover points 78 between MDR yarns 76 and CD monofilaments 74, as shown in FIG. 4*a*. While FIG. 4*a* illustrates crossover points 78, bonding may also occur where MD reinforcing yarns 76 pass below CD monofilament yarns at crossover points 80 as shown in FIG. 4*b*.

Bonding like polymers may provide strong bonds and may prevent delamination in a laminated forming fabric. In addition, thermal bonding yarns of like material may provide a means to stiffen structures such that they may resist distortion. Thus, dimensional stability may be increased and edge curl may be reduced.

Further, the bondable or meltable polymers retain a substantial portion of the original strength of the monofilaments after thermal bonding, thus maintaining high modulus of elasticity and dimensional stability.

Also, the fabrics of the present invention may have improved seam strength. Thermal bonds between top warps and top shutes are stronger than the frictional forces associated with the yarns holding the fabric seam. For example, shutes and warps may be formed from the same material with these shutes and warps being thermally bonded together. In another example, only the surface of the shutes may be formed from a material which, during thermal treatment melts and deforms. The deformation of the surface in these thermally treated monofilaments results in the shute being in more intimate contact with the warps such that the warps are subject to increased mechanical locking versus the mechanical locking (as a result of crimp only) that occurs in conventional forming fabric seams.

Accordingly, the fabrics of the present invention may improve seam strength, eliminate edge curl, improve sheet formation, improve dimensional stability and reduce fabric sleaze.

Although, the yarns formed from MXD6 have been described as bondable or meltable, the invention is not so limited. Yarns formed from MXD6 may be used in the present invention without bonding or melting. Specifically, MXD6 monofilament yarns may be used to form binder yarns in a laminated fabric, for example, a triple layer fabric. More specifically, it has been found that MXD6 monofilaments may have good wet to dry dimensional stability, like polyester and good abrasion resistance like polyamide.

Further, the use of MXD6 as the constituent of monofilament yarns will have good shrinkage, shrink force, good abrasion resistance and modulus of elasticity resulting in improved fabric wear and curl properties.

Thus the present invention its objects and advantages are realized, and although preferred embodiments have been disclosed and described in detail herein, its scope and objects should not be limited thereby; rather its scope should be determined by that of the appended claims.

I claim:

1. A papermaker's fabric for use as a forming fabric comprising:

plurality of machine direction (MD) yarns and cross machine direction (CD) yarns interwoven in a m-shed repeat pattern, wherein m≧2, and a plurality of MD (MDR) reinforcing yarns each having a n-shed repeat pattern, wherein n≧2, and said MDR yarns form knuckles with one CD yarn per repeat, wherein said MD and CD yarns, and said MDR yarns are monofilament yarns;

wherein at least some of said MDR yarns and at least some of said CD yarns have a first melting point temperature and the MD yarns have one or more melting point temperatures each higher than said first melting point temperature;

wherein said fabric is heated to a predetermined temperature which is at least equal to said first melting point temperature yet lower than each of said one or more melting point temperatures of the MD yarns; and wherein said MDR yarns which are in contact with or in close proximity to CD yarns prior to being heated, bond to said CD yarns after being heated to said predetermined temperature.

2. The papermaker's fabric according to claim 1, wherein at least some of said MDR yarns and at least some of said CD yarns are formed from MXD6.

3. The papermaker's fabric according to claim 2, wherein said MD yarns are formed from polyethylene naphthalate (PEN) or polyethylene terephthalate (PET).

4. The papermaker's fabric according to claim 2, wherein said first melting point temperature has a value in the range of approximately 230° C. to 234° C., and wherein said fabric is heated for a predetermined time which is in the range of approximately 60 to 180 seconds.

5. The papermaker's fabric according to claim 4, wherein the yarns are placed in tension having a value in the range of approximately 0.07 to 0.25 cN/dtex when said fabric is heated.

6. A method of manufacturing a papermaker's fabric for use as a forming fabric comprising the steps of:

weaving a plurality of machine direction (MD) yarns, cross machine direction (CD) yarns in a m-shed repeat pattern, wherein m≧2, and a plurality of MD (MDR) reinforcing yarns each having a n-shed repeat pattern, wherein n≧2, and said MDR yarns form knuckles with one CD yarn per repeat, wherein said MD and CD yarns, and said MDR yarns are monofilament yarns;

wherein at least some of said MDR yarns and at least some of said CD yarns have a first melting point temperature and the MD yarns have one or more melting point temperatures each higher than said first melting point temperature;

heating said fabric to a predetermined temperature which is at least equal to said first melting point temperature yet lower than each of said one or more melting point temperatures of the MD yarns; and wherein said MDR yarns which are in contact with or in close proximity to CD yarns prior to being heated, bond to said CD yarns after being heated to said predetermined temperature.

* * * * *